US006681830B1

(12) United States Patent
Vulpitta et al.

(10) Patent No.: US 6,681,830 B1
(45) Date of Patent: Jan. 27, 2004

(54) HAND-HELD ADHESIVE TAPE DISPENSER

(75) Inventors: Brian A. Vulpitta, Avon Lake, OH (US); Timothy S. Ferguson, Lakewood, OH (US)

(73) Assignee: Henkel Consumer Adhesives, Inc., Gulph Mills, PA (US)

( * ) Notice: Subject to any disclaimer, the term of this patent is extended or adjusted under 35 U.S.C. 154(b) by 179 days.

(21) Appl. No.: 09/723,538

(22) Filed: Nov. 28, 2000

(51) Int. Cl.[7] ..... B32B 31/00

(52) U.S. Cl. ..... 157/527; 156/523; 156/567; 156/577; 156/579; 225/39; 225/47; 225/56; 225/80; 225/86; 225/91; 206/389; 206/411; 242/588.6

(58) Field of Search ..... 225/39, 56, 80, 225/88, 91, 47; 206/389, 411; 156/527, 579, 523, 567, 577; 242/588.6

(56) References Cited

U.S. PATENT DOCUMENTS

| | | | | |
|---|---|---|---|---|
| 2,016,527 A | | 10/1935 | Voigt | |
| 2,324,204 A | | 7/1943 | Fischer | |
| 2,683,547 A | | 7/1954 | Fischer | |
| 2,722,331 A | | 11/1955 | Vogt | |
| 3,156,603 A | | 11/1964 | Robinson | |
| 3,645,831 A | * | 2/1972 | Thaeler | 156/527 |
| 3,895,059 A | | 7/1975 | Link | |
| 4,400,231 A | | 8/1983 | Martin | |
| 4,780,172 A | * | 10/1988 | Shea | 156/527 |
| D310,846 S | | 9/1990 | Sakurai | |
| 5,083,717 A | * | 1/1992 | Samuelson et al. | 242/55.53 |
| D328,097 S | | 7/1992 | Czech | |
| D328,098 S | | 7/1992 | Czech | |
| 5,171,397 A | * | 12/1992 | Arnold | 156/523 |
| 5,380,395 A | * | 1/1995 | Uchida | 156/577 |
| 5,470,162 A | | 11/1995 | Rubin | |
| D438,567 S | | 3/2001 | Van Den Berg | |

FOREIGN PATENT DOCUMENTS

| | | |
|---|---|---|
| CH | 406 897 | 1/1966 |
| EP | 779875 | 10/1999 |
| GB | 1447904 | 9/1976 |
| JP | 237434 | 1/1995 |
| JP | 86103383 | 9/1999 |
| WO | WO 9606790 A1 | 3/1996 |

* cited by examiner

*Primary Examiner*—Linda Gray
(74) *Attorney, Agent, or Firm*—Connolly Bove Lodge & Hutz

(57) ABSTRACT

A hand-held adhesive tape dispenser is in the form of a partial shell which has a support face and a peripheral wall to form an open face housing. A spool of adhesive tape is mounted to the support face through the use of mounting structure on the shell which rotatably and detachably mounts the core of the spool to the shell. The mounting structure includes spring fingers which snap over the core. An applicating end of the shell has a passage in its peripheral wall located near a fixed guide and a cutter at the applicating end so that tape removed from the core would pass through the passage around the guide to be applied to a substrate and then to be cut by the cutter.

19 Claims, 2 Drawing Sheets

HAND-HELD ADHESIVE TAPE DISPENSER

BACKGROUND OF THE INVENTION

Various types of adhesive tape dispensers are known which are intended to conveniently apply some form of adhesive tape to a substrate such as paper or the like. Such dispensers have taken various forms.

In general, the dispensers are most widely known in the form of desk dispensers and hand-held dispensers requiring the use of two hands, whereby the tape roll is stored on a revolving spool and can be cut at the desired length by means of a blade. There are also adhesive tape dispensers which can apply tape directly onto the paper, and which allow the tape to be cut using more or less elaborate cutting implements. Obviously, such adhesive tape dispensers are made up of a considerable number of components, and therefore are relatively large. Furthermore, changing rolls is often a complicated task.

One form of hand-held dispenser generally includes a closed housing in which a spool of tape is rotatably mounted. The tape extends out of the housing through an applicator tip. Frequently the applicator tip is provided with a cutter having a serrated edge intended to make a clean cut of the tape when the desired amount has been dispensed. One of the factors in suitability of such tape dispensers is the minimizing in the cost of manufacturing the dispensers without impairing the effectiveness of operation.

SUMMARY OF THE INVENTION

An object of this invention is to provide a hand-held adhesive tape dispenser which fulfills the above needs.

A further object of this invention is to provide such a dispenser, which can be easily manufactured with minimal parts at low cost without impairing the effectiveness in the operation of the dispenser.

In accordance with this invention a hand-held adhesive tape dispenser includes a partial shell, which has a support face and a peripheral wall extending outwardly from the support face to form an open face housing. A spool having adhesive tape thereon is detachably mounted to the housing by mounting structure, which includes spring fingers that snap over the spool. In a preferred practice of the invention the spring fingers may also be utilized to mount a carrier board to the open face of the housing for display purposes. The peripheral wall has an open space at the applicator end of the housing where a cutter is located and where a fixed guide is disposed so that a segment of a tape could extend from the spool through a passage near the fixed guide and then around the guide surface for being cut from the remainder of the tape.

In a preferred practice of the invention the dispenser is made of only three separate parts. One of the parts is the spool with its tape. Another separate part is the carrier board. The remaining part includes all other components of the dispenser which are of one-piece construction.

THE DRAWINGS

DETAILED DESCRIPTION

Figure 1:
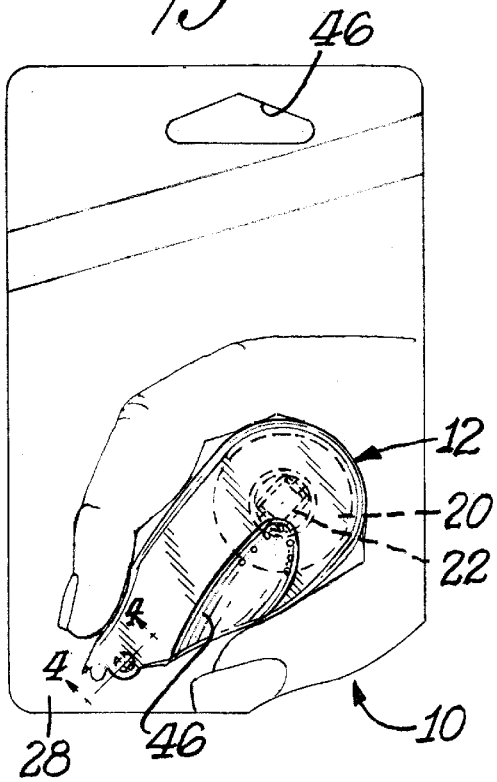
FIG. 1 is a front elevational view a hand-held adhesive tape dispenser in accordance with this invention.

The present invention is based upon variations of a tape dispenser as described in PCT Application Ser. No. PCT/1B00/00741, all of the details of which are incorporated herein by reference thereto. In general the invention involves a hand-held tape dispenser, which would initially be mounted to a carrier board functioning as a display board for the dispenser. Such carrier board could be made of any suitable material such as stiff paper or cardboard and could contain various information on one or both sides which would be useful to the user, such as directions for use as well as advertising information.

As illustrated, the dispenser 10 includes an open faced housing 12. Housing 12 is of generally tear drop shape with a widened end and a narrower applicating end or tip. Housing 12 is a partial shell having a support face 14 and a peripheral wall 16 extending outwardly from the support face 14. The partial shell or housing 12 is thus open on its face opposite the support face 14. A spool of adhesive tape is located in the widened end of housing 12. The spool includes a core 18 with the tape 20 mounted thereon in a conventional manner. Any suitable tape material may be used such as an acetate material.

Figure 2:
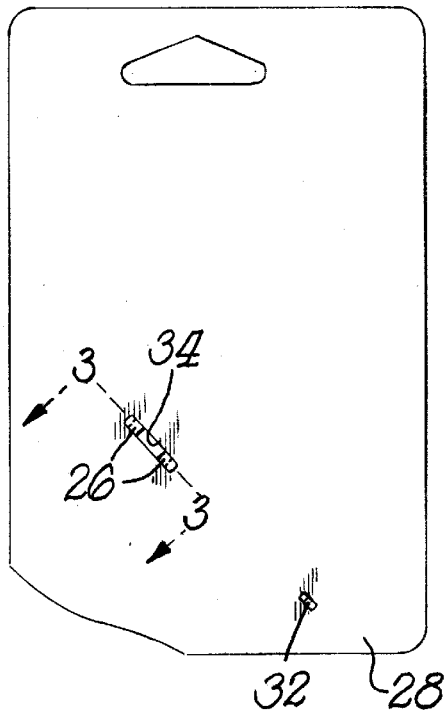
FIG. 2 is a rear elevational view of the dispenser shown in FIG. 1.
Figure 3:
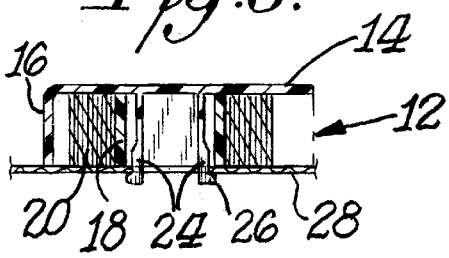
FIG. 3 is a cross-sectional view taken through FIG. 2 along the line 3—3.
Figure 4:
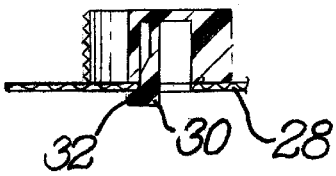
FIG. 4 is a cross-sectional view taken through FIG. 1 along the line 4—4.
Figure 6:
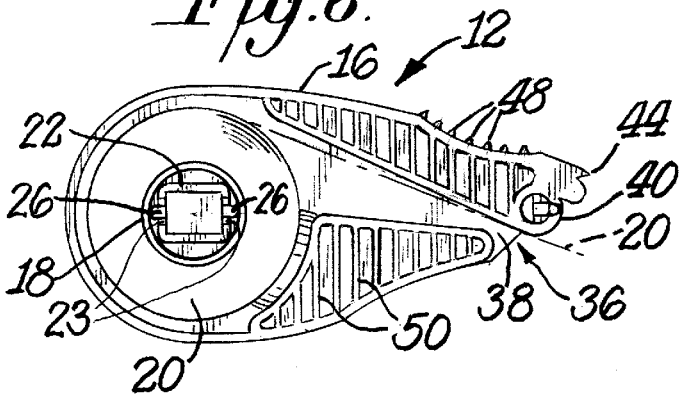
FIG. 6 is a rear elevational view of the dispenser shown in FIGS. 1–5 detached from the carrier board.

As best shown in FIGS. 1, 3 and 6 the core 18 is rotatably mounted to the housing and more specifically to the support face 14 by mounting structure which includes a boss 22, which is generally rectangular in shape and extends outwardly from support face 14. There is sufficient clearance between the inner surface of core 18 and the outer surface of boss 22 that core 18 freely rotates around boss 22. Opposite sides of boss 22 have slots 23 to form a pair of spring fingers 24 having outwardly directed tabs 26. Tabs 26 extend sufficiently outwardly to be snapped over core 18 thereby preventing dislodgment of the core 18 during normal use of the dispenser. There is sufficient clearance between tabs 26 and the outer surface of core 18 to accommodate the thickness of carrier board 28. Thus, FIG. 3 shows carrier board 28 sandwiched between tabs 26 and core 18. As shown in FIG. 2 tabs 26,26 extend through a slot 34 in carrier board 28. The use of the spring fingers permits the carrier board 28 to be readily removed from the dispenser housing 12 by the purchaser. As later described and as shown in FIGS. 1 and 4 a further spring finger 30 with its tab 32 is provided near the applicator end of dispensing housing 12 extending through a slot in carrier board 28 to act in cooperation with spring fingers 24 in mounting the housing 12 to the carrier board 28.

As illustrated housing 12 is thus reliably mounted directly to carrier board 28 without requiring a plastic bubble pack for the mounting.

As illustrated in FIG. 6 the applicator tip 36 of dispenser housing 12 has an open space in the peripheral wall 16 to create a discharge passage 38 so that a segment of the tape 20 can be unwound from core 18 and pass to the outside of dispenser housing 12.

Figure 10:
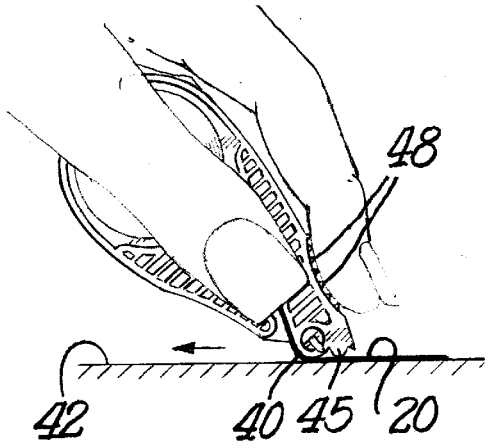
FIG. 10 is a rear elevational view similar to FIG. 5 showing the adhesive tape being dispensed.
Figure 11:
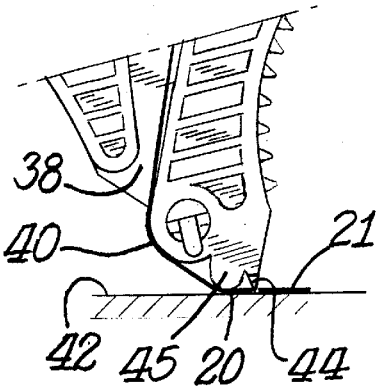
FIG. 11 is an enlarged fragmental rear elevational view showing the adhesive tape in the process of being cut.

As shown in FIGS. 6, 10 and 11 a fixed guide 40 is located at the discharge passage 38 so that the tape 20 would be guided around the outer arcuate guide surface of guide 40 onto a substrate 42 such as paper. The guide 40 is preferably a segment of a cylinder. If desired, however, a complete cylindrical member may be mounted near passage 38 to function as the guide member. Guide 40 is located adjacent to a serrated blade or cutter 44 so that the segment 21 of tape 20 applied to the substrate 42 can be cut from the remainder of the tape. The downstream most end of the remainder of the tape remains exposed to the structure at the exposed portion of applicator tip 36 so that a next segment of tape may be used.

While guide 40 is preferably non-movable or fixed to minimize parts, the guide could be a rotatable cylinder which would act as a roller to facilitate the tape dispensing.

Figure 5:
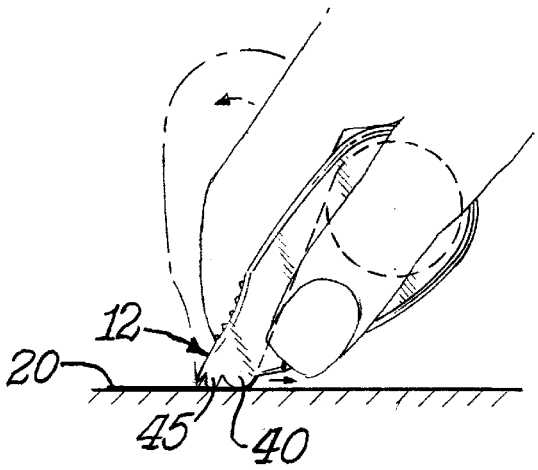
FIG. 5 is a front elevational view of the dispenser shown in FIGS. 1–4 detached from the carrier board and during the dispensing of tape.
Figure 8:
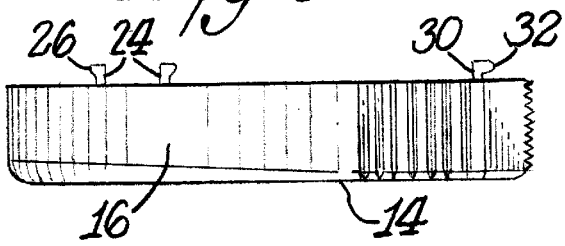
FIG. 8 is a top plan view of the dispenser shown in FIGS. 6–7.
Figure 7:
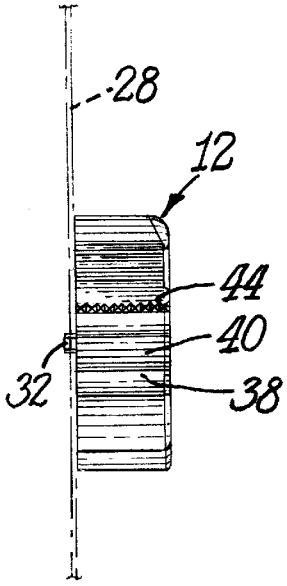
FIG. 7 is a side elevational view of the dispenser shown in FIG. 6 with the carrier board shown in phantom.

An advantage of the dispenser 10 is that the discharge passage 38 is the sole opening in the wall of the housing 12 particularly at the applicator tip 36 to assure that when a new spool of tape is being inserted and a segment of tape 20 is withdrawn from the spool the tape will exit the housing 12 only in the proper location, namely through the passage 38 and then around the guide surface 40. The adhesive side of the tape is pressed against the substrate 42 by guide member 40, as shown in FIGS. 5 and 10. The dispenser 10 is then pulled in the direction of the arrow shown in FIG. 10 to be applied to the substrate. When a proper amount of tape has been applied the housing is rotated as shown in phantom in FIG. 5 and as shown in FIG. 11 so that the cutter 44 cuts the segment 21 as shown in FIG. 16 leaving an adjacent portion 20 exposed from the dispenser while the severed segment 21 remains on the substrate.

Serrations or dimples could be located at passage 38 so that the end of the remaining tape, after segment is cut, will stick to these serrations and not retract into the housing.

As illustrated housing 12 includes a small guide cheek 45 disposed close to cutter blade 44. Cheek 45 has a number of functions. For example, cheek 45 acts as an outer guide member to hold the tape in its proper position while the tape 20 is being dispensed. As shown in FIG. 10, for example, during the dispensing operation the guide 40 presses the tape 20 against the paper or substrate 42. At the same time the cheek 45 also presses against the paper or substrate 42, thus assuring the proper dispensing angle being achieved when both the guide 40 and cheek 45 are disposed against the substrate. Because the cheek is located along the support face of the housing 12 the cheek is located slightly outwardly of the tape itself and thus functions as a guide confining the tape along a path that would be located across cutter 44 during the later cutting operation, thus, keeping the tape in position on the guide 40. As also shown in FIG. 10 cheek 45 functions to hold the cutter 44 elevated above and out of contact with the tape 20 during the tape application process. The cheek is preferably rounded rather than being sharply pointed so as to function as a rolling pivot member. Thus, when it is desired to cut the segment 21 from tape 20 the dispenser is rotated about cheek 45 until the cutter 44 makes contact with the tape 20 as shown in FIG. 11. This arrangement, which assures elevating the cutter completely out of contact with the substrate during the dispensing operation helps to minimize damage as by tearing of the substrate while the tape is being applied and then permits a sharp cut when the dispenser is pivoted about cheek 45 to move the cutter into contact with the tape 20.

When the tape has been completely dispensed a new spool could be mounted to housing 12. First spring fingers 24,24 would be squeezed together sufficiently to withdraw the empty core 18. The new spool could be slid over boss 22 when the spring fingers are squeezed toward each other to be mounted in place. The free end of the tape would be pulled through housing 12 and out of discharge passage 38 ready for the next tape application.

The dispenser 10 would initially be mounted to the carrier board 28 which could have a hole 46 for being mounted, for example, to a hook as part of a display in a store. When it is desired to remove the housing 12 from the carrier board the housing and carrier board are simply pulled apart and released from each other due to the springiness of the fingers 24,30. The tabs 26 prevent the spool of tape from being dislodged from the housing. The housing is then manipulated to apply the tape in the manner shown in FIGS. 5, 10 and 11 with all of these operations taking place with the use of only one hand.

Figure 9:
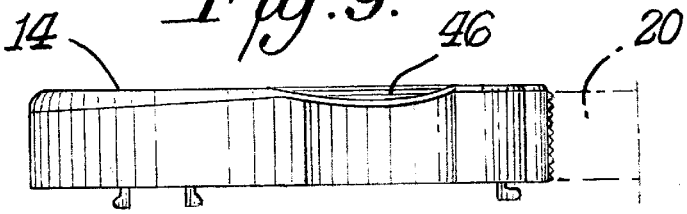
FIG. 9 is a bottom plan view of the dispenser shown in FIGS. 6–8.

Housing 12 is ergonomically shaped and generally has a teardrop shaped appearance. Housing 12 may include a thumb receiving recess 46, as shown in FIGS. 1 and 9, and may further include grip ribs 48 shown in FIGS. 6 and 11 for receiving the forefinger of the user. If desired, stiffening ribs 50 could be molded to support face 14 to further rigidify the housing 12.

An advantage of the slotted boss 22 is to allow for shrinkage of the spool of tape under certain temperature conditions. A further feature of the spool is that it is of only single wall thickness thus providing extra space within the housing to accommodate a greater length of tape. For example, the tape 20 may be wrapped around core 18 a distance of one-half inch or greater in a radial direction from the outer surface of core 18 outwardly. The spool of tape almost completely fills the widened end of housing 12 as shown in FIG. 6. This provides an improvement over conventional spools which are of double wall thickness and wherein the amount of tape extends radially from the outer wall by a distance of less than one-half inch where the overall diameter of the housing 12 at its wide end where core 18 is located need be no larger than 1.5 inches. The overall diameter of the tape roll would be about 1.5 inches with a tape length of at least 350 inches. Where the tape roll has a diameter of 1.25 inches the tape length would be at least about 300 inches. The width of the tape could be of any dimension as determined by such factors as ease of handling the dispenser since the dispenser itself does not otherwise restrict the width of the tape.

As indicated above the tape may be wrapped around the core a distance of one-half inch or greater in a radial direction from the outer surface of core 18 outwardly. This would mean that the total thickness of the tape would be one inch or greater in the diametric direction from the outer core. As also indicated above the overall diameter of the tape roll would would be about 1.5 inches. Accordingly, since the tape itself would have a thickness in the diametric direction of one inch or greater, the diameter of the core itself would be about one-half inch or less.

A further advantage of the present invention is that it lends itself to a minimal number of parts. The dispenser 10, for example, could comprise only three parts. One part would be the carrier board 28. Another part would be the spool of tape. All of the remaining components would be integrally molded to form the third part. It is to be understood, however, that if desired various of these components could be separate members.

What is claimed is:

1. A hand-held adhesive tape dispenser comprising a partial shell, said shell having a support face and a peripheral wall extending outwardly from said support face to form an open face housing, a core in said housing having adhesive tape wound thereon, mounting structure on said shell rotatably detachably mounting said core to said shell, said mounting structure including spring fingers which snap over said core, said shell having an applicating end, said peripheral wall having an open space, a cutter in said open space extending externally of said wall, a guide in said open space disposed adjacent to said cutter, said guide having a guide surface externally of said wall, said guide being spaced from said wall to create a discharge passage for a segment of said tape to extend from said core through said passage and around said guide surface for being cut by said cutter from the remainder of said tape, including a carrier board, said mounting structure mounting said carrier board to said open face of said housing, each of said spring fingers extending through a slot in said carrier board for detachably mounting said carrier board to said housing, a further spring finger mounted to said support face located remote from said mounting structure spring fingers, and said further spring finger extending through a slot in said carrier board to cooperate with said mounting structure spring fingers in mounting said carrier board to said housing.

2. The dispenser of claim 1 wherein said passage is the sole opening in the side wall of said shell to assure the proper positioning of said tape as it exits from said housing.

3. The dispenser of claim 1 wherein said guide surface is of arcuate shape, and said guide is a fixed non-movable guide.

4. The dispenser of claim 1 including a cheek mounted adjacent to said cutter for elevating said cutter during the dispensing of said tape.

5. The dispenser of claim 4 wherein said cheek has an arcuate surface whereby said cheek may function as a rolling pivot member when said dispenser is being moved from the dispensing position to the cutting position, said cheek being between said guide surface and said cutter, said cheek and said guide surface being aligned with each other while said cutter is elevated when said guide surface is disposed against a surface to which said tape is applied, and said cheek and said cutter being aligned with each other and said guide surface is elevated above the surface to which said tape is applied when said cutter is disposed in its tape cutting position.

6. The dispenser of claim 1 wherein said mounting structure and said guide and said cutter are integral with said shell.

7. The dispenser of claim 1 wherein said dispenser is of three-part construction comprising said shell as one part and said carrier board as a second part and said core with said tape as a third part.

8. The dispenser of claim 1 wherein each of said spring fingers and said further spring finger terminates in a tab extending through its respective slot.

9. The dispenser of claim 1 wherein said housing is of generally tear drop shape having an arcuate wide end and a narrow end remote from said wide end, said narrow end comprising said applicating end, said core and said tape being located in and substantially filling said wide end, said core being of single wall thickness, and said tape extending radially around said core to a radial thickness of at least ½ inch.

10. The dispenser of claim 9 wherein said core and said tape substantially fills said wide end, said core being of single wall thickness, and said tape extending radially around said core to a radial thickness of at least ½ inch.

11. The dispenser of claim 9 wherein said wide end is of semicircular shape, and said core being uniformly spaced from peripheral wall at said wide end.

12. A hand-held adhesive tape dispenser comprising a partial shell, said shell having a support face and a peripheral wall extending outwardly from said support face to form an open face housing, a core in said housing having adhesive tape wound thereon, mounting structure on said shell rotatably detachably mounting said core to said shell, said mounting structure including spring fingers which snap over said core, said shell having an applicating end, said peripheral wall having an open space, a cutter in said open space extending externally of said wall, a guide in said open space disposed adjacent to said cutter, said guide having a guide surface externally of said wall, said guide being spaced from said wall to create a discharge passage for a segment of said tape to extend from said core through said passage and around said guide surface for being cut by said cutter from the remainder of said tape, and said mounting structure comprising a boss having a wall which is slotted at two different locations to create said spring fingers and to allow for any shrinkage of said tape.

13. The dispenser of claim 12 including a carrier board, and said mounting structure mounting said carrier board to said open face of said housing.

14. The dispenser of claim 12 wherein said boss is generally rectangular shape.

15. The dispenser of claim 12 including a cheek mounted adjacent to said cutter for elevating said cutter during the dispensing of said tape.

16. The dispenser of claim 15 wherein said cheek has an arcuate surface whereby said cheek may function as a rolling pivot member when said dispenser is being moved from the dispensing position to the cutting position, said cheek being between said guide surface and said cutter, said cheek and said guide surface being aligned with each other while said cutter is elevated when said guide surface is disposed against a surface to which said tape is applied, and said cheek and said cutter being aligned with each other while said guide surface is elevated above the surface to which said tape is applied when said cutter is disposed in its tape cutting position.

17. The dispenser of claim 12 wherein said housing is of generally tear drop shape having an arcuate wide end and a narrow end remote from said wide end, said narrow end comprising said applicating end, said core and said tape being located in and said wide end, said core and said tape substantially filling said wide end, said core being of single wall thickness, and said tape extending radially around said core to a radial thickness of at least ½ inch. said core and said tape substantially fills said wide end, said core being of single wall thickness, and said tape extending radially around said core to a radial thickness of at least ½ inch.

18. The dispenser of claim 17 wherein said dispenser is of three-part construction comprising said shell as one part and said carrier board as a second part and said core with said tape as a third part.

19. The dispenser of claim 12 wherein said passage is the sole opening in the side wall of said shell to assure the proper positioning of said tape as it exits from said housing.

* * * * *